US008092962B2

(12) United States Patent
Saitou

(10) Patent No.: US 8,092,962 B2
(45) Date of Patent: Jan. 10, 2012

(54) IMAGE FORMING APPARATUS AND IMAGE FORMING METHOD

(75) Inventor: Makoto Saitou, Shiga (JP)

(73) Assignee: Kyocera Corporation, Kyoto (JP)

( * ) Notice: Subject to any disclaimer, the term of this patent is extended or adjusted under 35 U.S.C. 154(b) by 147 days.

(21) Appl. No.: 12/065,260

(22) PCT Filed: Aug. 29, 2007

(86) PCT No.: PCT/JP2007/066816

§ 371 (c)(1),
(2), (4) Date: Apr. 29, 2009

(87) PCT Pub. No.: WO2008/026665

PCT Pub. Date: Mar. 6, 2008

(65) Prior Publication Data

US 2009/0214977 A1 Aug. 27, 2009

(30) Foreign Application Priority Data

Aug. 31, 2006 (JP) ..... 2006-236034

(51) Int. Cl.
*G03G 13/01* (2006.01)

(52) U.S. Cl. ..... 430/45.1; 430/45.51; 399/223; 399/299

(58) Field of Classification Search ..... 430/45.5, 430/45.1, 46.5, 107.1, 45.51; 399/223, 299
See application file for complete search history.

(56) References Cited

U.S. PATENT DOCUMENTS

| | | | | |
|---|---|---|---|---|
| 5,837,414 | A * | 11/1998 | Kitani et al. | 430/108.1 |
| 7,139,496 | B1 * | 11/2006 | Roof et al. | 399/45 |
| 2004/0265016 | A1 * | 12/2004 | Kitani et al. | 399/298 |

FOREIGN PATENT DOCUMENTS

| | | | |
|---|---|---|---|
| JP | 09-152791 | | 6/1997 |
| JP | 11095567 | A | 4/1999 |
| JP | 2003005581 | A | 1/2003 |
| JP | 2003043769 | A | 2/2003 |
| JP | 2004-233914 | | 8/2004 |
| JP | 2006-162951 | | 6/2006 |

OTHER PUBLICATIONS

Toner description for multi-function printer Model KM-C2630/KM-C2630D from Kyocera Mita Corporation website http://www.kyoceramita.co.jp/products/other/index.html, Jul. 16, 2009 (with partial English translation).

Announcement of product Multi-function printer Model KM-C2630/KM-2630D released on Oct. 1, 2003 from Kyocera Mita Corporation website http://www.kyoceramita.co.jp/news/rls_b2003/rls20031001.html (with partial English translation).

Japanese language Information Statement submitted by third party and its English language translation for Japanese application 2008255839 lists the references above, submitted Jul . 25, 2009.

Chinese language office action and its English translation for corresponding Chinese application 200780000824.7, issuing date Oct . 9, 2009.

* cited by examiner

*Primary Examiner* — Janis L Dote
(74) *Attorney, Agent, or Firm* — DLA Piper LLP (US)

(57) ABSTRACT

The present invention relates to an image forming apparatus 1 including a photosensitive member 2 on which an electrostatic latent image is formed according to an image signal, a development mechanism 5 for forming a toner image by developing the electrostatic latent images, and a transfer body 60 for transferring the toner image. The development mechanism 5 includes a plurality of developing units 51-54 holding different kinds of toners. A second work of adhesion between the photosensitive member 2 and a second toner to be transferred to the transfer body second is larger than a first and a third work of adhesions between the photosensitive member 2 and a first and a third toners to be transferred to the transfer body first and third.

6 Claims, 6 Drawing Sheets

FIG.4

| Order of Image Transfer | | | |
|---|---|---|---|
| First Cycle | Second Cycle | Third Cycle | Fourth Cycle |
| Cyan | Magenta | Yellow | Black |
| Yellow | Magenta | Cyan | Black |
| Magenta | Cyan | Yellow | Black |
| Yellow | Cyan | Magenta | Black |
| Cyan | Yellow | Magenta | Black |
| Magenta | Yellow | Cyan | Black |

FIG.5

| | First Cycle | Second Cycle | Third Cycle | Fourth Cycle |
|---|---|---|---|---|
| | 100% | 102.0~ 132.7% | 79.9~ 120.5% | 73.8~ 118.5% |
| Work of Adhesion (mN/m) High | 61.7mN/m | 64.5mN/m | 61.7mN/m | 68.5mN/m |
| Low | 42.4mN/m | 52.9mN/m | 46.2mN/m | 37.7mN/m |

IMAGE FORMING APPARATUS AND IMAGE FORMING METHOD

TECHNICAL FIELD

The present invention relates to an image forming apparatus such as a printer and a copier utilizing electrophotographic method, and also relates to an image forming method.

BACKGROUND ART

In an image forming apparatus utilizing electrophotographic method, an electrostatic latent image is formed on a photosensitive member and is developed by a developing device to form a toner image, which is first transferred to an intermediate transfer body and then transferred second and fixed to a recording medium such as paper. When performing full-color printing with such image forming apparatus, four toners of yellow, magenta, cyan and black are used. The toner images are first transferred to and superposed on an intermediate transfer body by a four-cycle system or a four-tandem system, and then secondly transferred and fixed to a recording medium (refer to the patent document 1-3, for example).

In the four-cycle method, toner images of yellow, magenta, cyan and black are successively formed on one photosensitive member, and then first image transfers of the toner images to an intermediate transfer body are successively performed. Meanwhile, in the four-tandem method, a plurality of photosensitive members are prepared for forming each of the toner images on a respective one of the photosensitive members, and first image transfers of the toner images to an intermediate transfer body are successively performed.

However, in the image forming apparatuses utilizing such systems, even after transferring the toner images of the photosensitive members, the toners partly remain on the photosensitive member. The residual toner may be removed by a cleaning device, still, it is difficult to completely remove the toner. When image forming is performed using a photosensitive member with unduly remaining toner, flaws of black spots or image deletion may be caused. Especially when using the image forming apparatus repeatedly, fusion of the residual toner may occur, thereby constantly causing flaws in images.

Further, by repeatedly using the image forming apparatus, the surface condition (surface free energy) of the photosensitive member may be changed, and thus the adherence (work of adhesion) between the toner and the photosensitive member is changed. As a result, quality of the toner image transferred from the photosensitive member to the intermediate transfer body may get deteriorated with use of the image forming apparatus, so that flaws in images are likely to be caused.

Flaws in images largely affect the duration of guarantee of an image forming apparatus for forming images of a constant quality. Especially, when performing full-color printing, it is required to have an image property higher than when performing black-and-white printing. Thus, the image forming apparatus for full-color printing is highly required to prevent flaws in images for a long period.

Patent Document 1: JP-A-2006-162951
Patent Document 2: JP-A-2004-233914
Patent Document 3: JP-A-9-152791

DISCLOSURE OF THE INVENTION

An object of the present invention is to prevent undue adhesion or fusion of toner at a photosensitive member for enhancing quality of an image transferred to a transfer body, so that flaws in images are prevented and images of high quality are obtained for a long period.

The present invention attains the above object by focusing on the influence on the image property, which is exerted by the order of image transfer of toners to a transfer body as well as by the work of adhesion between toners and a photosensitive member.

According to a first aspect of the present invention, there is provided an image forming apparatus comprising: one or a plurality of photosensitive members on which an electrostatic latent image is formed according to an image signal; a development mechanism for forming a toner image by developing the electrostatic latent images; and a transfer body for transferring the toner image. The development mechanism includes a plurality of developing units holding different kinds of toners. A second work of adhesion between the photosensitive member and a second toner to be transferred to the transfer body second is larger than a first and a third work of adhesions between the photosensitive member and a first and a third toners to be transferred to the transfer body first and third.

According to a second aspect of the present invention, there is provided an image forming method comprising the steps of: forming an electrostatic latent image on one or a plurality of photosensitive members according to an image signal; forming a toner image by developing the electrostatic latent image using different kinds of toners; and transferring the toner image to a transfer body. The different kinds of toners are selected so that a second work of adhesion between the photosensitive member and a second toner to be transferred to the transfer body second is larger than a first and a third work of adhesions between the photosensitive member and a first and a third toners to be transferred to the transfer body first and third.

Preferably, the second work of adhesion is not less than 102.0% and not more than 132.7% of the first work of adhesion. The third work of adhesion is not less than 79.9% and not more than 120.5% of the first work of adhesion.

Preferably, the first work of adhesion is not less than 42.4 mN/m and not more than 61.7 mN/m, the second work of adhesion is not less than 52.9 mN/m and not more than 64.5 mN/m, and the third work of adhesion is not less than 46.2 mN/m and not more than 61.7 mN/m.

Preferably, the different kinds of toners include yellow, magenta, and cyan toners, and the second toner is one of the yellow, magenta, and cyan toners.

Preferably, the different kinds of toners further include a black toner, and the black toner is transferred to the transfer body fourth.

Preferably, the forming of the toner image on the photosensitive member and the transfer of the toner image to the transfer body are successively performed for each of the different kinds of the toners, and the toner images of the different kinds of the toners being superposed on the transfer body. Accordingly, the present invention may be applied to an image forming apparatus utilizing a multi-cycle system, typically a four-cycle system.

Preferably, the forming of the toner image on each of the plurality of photosensitive members is performed by a respective one of the different kinds of the toners, and then the transfer of the toner images of the different kinds of the toners are successively transferred to the transfer body, and the toner images of the different kinds of the toners being superposed on the transfer body. Accordingly, the present invention may be applied to an image forming apparatus utilizing a multi-tandem system, typically a four-tandem system.

Preferably, the photosensitive member is an amorphous silicon photosensitive member.

In the present invention, the work of adhesion of the second toner to be transferred second (the second work of adhesion) is set to be larger than that of the toners which are to be transferred first and third (the first work of adhesion and the third work of adhesion). With such structure, undue adhesion or fusion of the toner at the electrophotographic photosensitive member is prevented, and thus quality of the toner image transferred to the transfer body is enhanced. As a result, in the present invention, images of high quality without flaws of black spots or image deletion are obtained for a long period.

BRIEF DESCRIPTION OF THE DRAWINGS

FIG. 4 is a table illustrating the order of image transfer of toners in image forming process.

FIG. 5 is a table illustrating the relationship between the order of image transfer of toners in image forming process and the work of adhesion.

LEGENDS

1, 1', 1" Image Forming Apparatus
2, 24"-27" Electrophotographic Photosensitive Member
51-54, 51'-54', 51"-54" Developing Units
60 Intermediate Transfer Belt

BEST MODE FOR CARRYING OUT THE INVENTION

An image forming apparatus according to the present invention is specifically described below with reference to the accompanying drawings.

First, a first embodiment of the present invention is described with reference to FIGS. 1-5.

Figure 1:
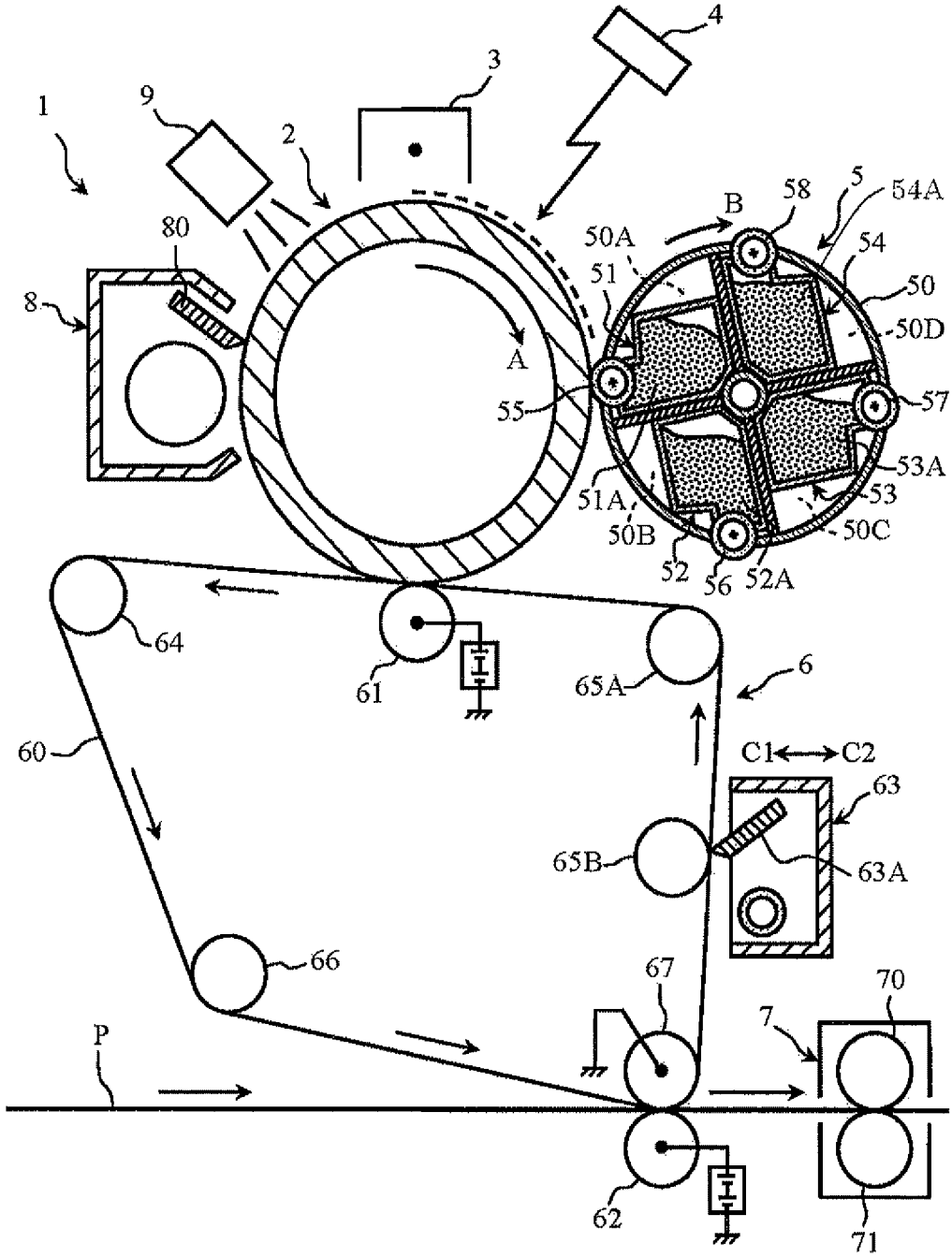
FIG. 1 is a sectional view schematically illustrating an image forming apparatus according to a first embodiment of the present invention.

An image forming apparatus 1 shown in FIG. 1 utilizes a four-cycle system for full-color printing, and includes an electrophotographic photosensitive member 2, an electrification mechanism 3, an exposure mechanism 4, a development mechanism 5, a transfer mechanism 6, a fixing mechanism 7, a cleaning mechanism 8, and a discharging mechanism 9.

Figure 2:
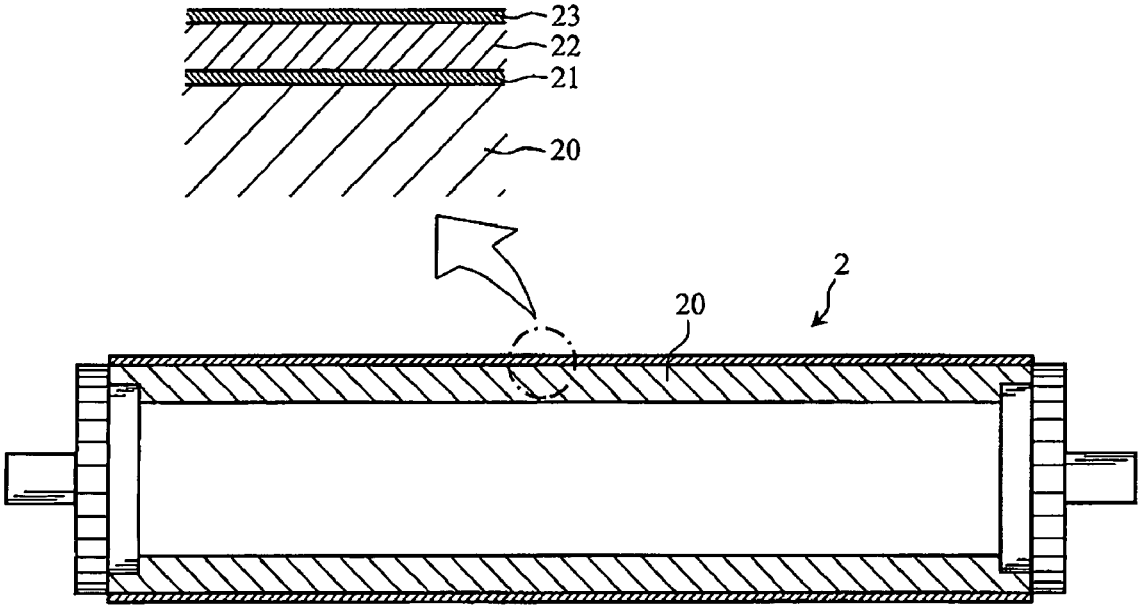
FIG. 2 is a sectional view and its enlarged view of the principal portions, illustrating an electrophotographic photosensitive member used in the image forming apparatus of FIG. 1.

An electrophotographic photosensitive member 2 forms an electrostatic latent image or a toner image according to an image signal, and is rotatable in the direction of an arrow A in the figure. As shown in FIG. 2, the electrophotographic photosensitive member 2 includes a cylindrical body 20 having a circumference on which an anti-carrier injection layer 21, a photoconductive layer 22, and a surface layer 23 are formed.

Such cylindrical body 20 forms the skeleton of the electrophotographic photosensitive member 2, and is conductive at least on its surface. Specifically, the cylindrical body 20 may be made of a conductive material as a whole, or may be made of an insulating material having a conductive film formed thereon. Preferably, the cylindrical body is formed of Al alloy material as a whole. In this way, the electrophotographic photosensitive member 2 having a light weight can be made at a low cost, and further, the adhesion of the cylindrical body to the anti-carrier injection layer 21 and the photoconductive layer 22 is reliably enhanced when forming the layers by amorphous silicon (a-Si) material.

The anti-carrier injection layer 21 prevents injection of carriers (electrons and electron holes) from the cylindrical body 20 into the photoconductive layer 22, and is made of a-Si material, for example. Specifically, the anti-carrier injection layer 21 is made of a-Si material containing boron (B), nitrogen (N) or oxygen (O) as a dopant, and has a thickness of not less than 2 μm and not more than 10 μm.

In forming the anti-carrier injection layer 21 using a-Si material, the material may contain a thirteenth group element or a fifteenth group element of the periodic system in an amount larger than those contained in a-Si material of the photoconductive layer 22 so as to determine the conductivity type. Further, a large amount of C, N, O may be also contained so as to have high resistivity.

In the photoconductive layer 22, electrons are excited by a laser irradiation from the exposure mechanism 4 (see FIG. 1), and a carrier of free electrons or electron holes is generated. The photoconductive layer is formed of a-Si material or amorphous selenium material (a-Se), for example. As the a-Si material, a-Si, a-SiC, a-SiN, a-SiO, a-SiGe, a-SiCN, a-SiNO, a-SiCO or a-SiCNO may be used, while as the a-Se material, a-Se, Se—Te, and $As_2Se_3$ may be used. Especially when the photoconductive layer 22 is made of a-Si, it is able to have high luminous sensitivity, high-speed responsiveness, stable repeatability, high heat resistance, high endurance, and so on, thereby reliably obtaining enhanced electrophotographic property. When the anti-carrier injection layer 21 is made of a-Si material, adhesion of the photoconductive layer to the anti-carrier injection layer 21 is enhanced. In addition, by forming the surface layer 23 using a-SiC:H, conformity of the photoconductive layer with the surface layer 23 is enhanced. The thickness of the photoconductive layer 22 is set according to the photoconductive material and desired electrophotographic property. When the photoconductive layer 22 is made of a-Si material, the thickness is normally set to not less than 5 μm and not more than 100 μm, preferably, not less than 15 μm and not more than 80 μm.

The surface layer 23 for protecting the photoconductive layer 22 from friction and wear is laminated on the surface of the photoconductive layer 22. The surface layer 23 is formed of a-Si material such as amorphous silicon carbide (a-SiC) and amorphous nitride silicon (a-SiN) or amorphous carbon (a-C), and has a thickness of not less than 0.2 μm and not more than 1.5 μm, for example.

The electrophotographic photosensitive member 2 may include a long-wavelength light absorbing layer in place of the anti-charge injection layer 21, or in addition to the anti-charge injection layer 21. The long-wavelength light absorbing layer prevents exposure light, which is long-wavelength light, from reflecting on the surface of the cylindrical body 20, and thus prevents a fringe pattern from being generated at a formed image. The electrophotographic photosensitive member 2 may further include, between the photoconductive layer 22 and the surface layer 23, a carrier excitation layer for enhancing luminance.

The electrification mechanism 3 shown in FIG. 1 constantly charges the surface of the electrophotographic photosensitive member 2 positively or negatively, according to types of photoconductive layer of the electrophotographic photosensitive member 2. The electrification potential at the electrophotographic photosensitive member 2 is normally set to not less than 200V and not more than 1000V.

The exposure mechanism 4 forms an electrostatic latent image on the electrophotographic photosensitive member 2, and is capable of emitting laser light, for example. The exposure mechanism 4 forms an electrostatic latent image on the electrophotographic photosensitive member 2 by emitting laser light on the surface of the electrophotographic photosensitive member 2 according to an image signal, and lowering the electrical potential at the emitted portion.

The development mechanism 5 forms a toner image by developing the electrostatic latent image formed on the electrophotographic photosensitive member 2, and is provided with a rotary holder 50 and developing units 51, 52, 53, 54.

The rotary holder 50 supports the developing units 51, 52, 53, 54, and also selects one to be used from the developing units 51, 52, 53, 54. The rotary holder 50 is rotatable in the direction of an arrow B, and includes spaces 50A, 50B, 50C, 50D for accommodating the developing units 51, 52, 53, 54.

Each of the developing units 51, 52, 53, 54 develops (to make visible) an electrostatic latent image formed on the electrophotographic photosensitive member 2. The developing units 51, 52, 53, 54 hold toners 51A, 52A, 53A, 54A, and are provided with sleeves 55, 56, 57, 58, respectively.

The toners 51A-54A are used to form toner images on the surface of the electrophotographic photosensitive member 2, of yellow, magenta, cyan, and black, respectively. The toners 51A-54A are frictionally charged in the developing units 51-54. Each of the toners 51A-54A may be a binary developer of magnetic carrier and insulating toner, or a one-component developer of magnetic toner. The colors of the toners 51A-54A are not limited to yellow, magenta, cyan, and black.

As shown in FIG. 3, in the development mechanism 5, by rotating the developing units 51-54 in the rotary holder 50, a desired one of the developing units 51-54 is brought into contact with the electrophotographic photosensitive member 2 at a respective one of the sleeves 55-58. In this way, the electrostatic latent image on the electrophotographic photosensitive member 2 is developed by a desired one of the developing units 51-54 (a toner of a desired color).

The transfer mechanism 6 transfers the toner image of the electrophotographic photosensitive member 2 on a recording paper P. The transfer mechanism 6 includes an intermediate transfer belt 60, a first transfer roller 61, a second transfer roller 62, and a cleaning device 63.

The intermediate transfer belt 60 transfers the toner image of the electrophotographic photosensitive member 2, and is moved in the direction of arrows in the figure, by a driving roller 64, driven rollers 65A, 65B, a tension roller 66, and a back-up roller 67.

The first transfer roller 61 transfers the toner image of the electrophotographic photosensitive member 2 to the intermediate transfer belt 60. To the first transfer roller 61, e.g. a direct-current transfer voltage is applied for drawing the toner image on the electrophotographic photosensitive member 2 toward the first transfer roller 61. The intermediate transfer belt 60 passes through between the electrophotographic photosensitive member 2 and the first transfer roller 61, so that the toner image on the electrophotographic photosensitive member 2 is transferred to the intermediate transfer belt 60 when a transfer voltage is applied to the first transfer roller 61.

The second transfer roller 62 transfers the toner image on the intermediate transfer belt 60 to a recording paper P. The intermediate transfer belt 60 passes through between the second transfer roller and the back-up roller 67. Similarly to the first transfer roller 61, to the second transfer roller 62 e.g. a direct-current transfer voltage is applied for drawing the toner image on the intermediate transfer belt 60 toward the second transfer roller 62. The recording paper P passes through between the intermediate transfer belt 60 and the second transfer roller 62, so that the toner image on the intermediate transfer belt 60 is transferred to the recording paper P when a transfer voltage is applied to the second transfer roller 62.

The cleaning device 63 removes the toner remaining on the surface of the intermediate transfer belt 60, and includes a cleaning blade 63A. In the cleaning device 63, the toner remaining on the surface of the intermediate transfer belt 60 is scraped off by the cleaning blade 63A and is collected. The cleaning device 63 is reciprocable in the direction of arrows C1, C2 in the figure. Except when scraping off the toner remaining on the intermediate transfer belt 60, the cleaning blade 63A is retracted away from the intermediate transfer belt 60.

The fixing mechanism 7 fixes the toner image transferred to the recording paper P, and includes a pair of fixing rollers 70, 71. In the fixing mechanism 7, the recording paper P passes through between the fixing rollers 70, 71, so that the toner image transferred to the recording paper P is fixed on the recording paper P by heat or pressure.

The cleaning mechanism 8 removes the toner remaining on the surface of the electrophotographic photosensitive member 2, and includes a cleaning blade 80. In the cleaning mechanism 8, the toner remaining on the surface of the electrophotographic photosensitive member 2 is scraped off by the cleaning blade 80 and is collected. The toner collected in the cleaning mechanism 8 is recycled at the development mechanism 5, if necessary.

The cleaning blade 80 is supported by an engaging means such as a spring in a manner so that its tip end is pressed onto the electrophotographic photosensitive member 2. The cleaning blade 80 is made of a rubber material mainly containing polyurethane resin, and its tip end brought into contact with the surface layer 23 has a thickness of not less than 1.0 mm and not more than 1.2 mm, a blade linear pressure of not less than 5 gf/cm and not more than 30 gf/cm, and a hardness of not less than 67 degrees and not more than 84 degrees (in JIS hardness).

The discharging mechanism 9 removes surface charge on the electrophotographic photosensitive member 2. The discharging mechanism 9 utilizes e.g. light irradiation for removing the surface charge of the electrophotographic photosensitive member 2.

Next, the operation of the image forming apparatus 1, or a method of image forming will be described below.

Since the image forming apparatus 1 utilizes a four-cycle system, toner images of yellow, magenta, cyan and black are formed on the intermediate transfer belt 60 in a predetermined order, and these toner images are superposed on the intermediate transfer belt 60. Such superposition of the toner images on the intermediate transfer belt 60 is performed in the following way.

First, the surface of the electrophotographic photosensitive member 2 is constantly charged positively or negatively by the electrification mechanism 3, and then, according to an image signal, the electrophotographic photosensitive member 2 is exposed by the exposure mechanism 4 to form an electrostatic latent image. Next, the rotary holder 50 of the development mechanism 5 is rotated by 90 degrees (or is already rotated by 90 degrees in advance), and a desired one of the sleeves 55-58 of the developing units 51-54 is brought into contact with the electrophotographic photosensitive member 2, whereby the electrostatic latent image on the electrophotographic photosensitive member 2 is developed to form a toner image. Subsequently, a transfer voltage is applied to the first transfer roller 61 so as to transfer the toner image of the electrophotographic photosensitive member 2 is transferred to the intermediate transfer belt 60. Such electrification, exposure, development and first image transfer at the electrophotographic photosensitive member 2 is performed for each of the toners of yellow, magenta, cyan and black, in a predetermined order.

As shown in FIG. 4, in the image transfer to the intermediate transfer belt 60, the toner image of the black toner is transferred finally, while the order of image transfer of the other colors is not particularly limited. However, as can be seen from FIG. 4, the order of image transfer of yellow, magenta, and cyan toners to the electrophotographic photosensitive member 2 is decided such that the work of adhesion between the electrophotographic photosensitive member 2 and the toner to be transferred second to the intermediate transfer belt 60 is larger than the work of adhesion between the electrophotographic photosensitive member 2 and the toners to be transferred first and third.

Here, the work of adhesion depends on the surface free energy of the electrophotographic photosensitive member 2 and the toner. In the image forming apparatus 1, the toner images of the yellow, magenta, and cyan toners are formed on the same electrophotographic photosensitive member 2. Thus, in the image forming apparatus 1, the work of adhesion between the electrophotographic photosensitive member 2 and the toners is substantially depends on the surface free energy of the toners. The surface free energy of the toners depends on the compositions of the toners. Therefore, in the image forming apparatus 1, the order of image transfer is decided according to the compositions of the yellow, magenta and cyan toners, or the compositions of the toners are decided according to the order of image transfer, so that the work of adhesion between the electrophotographic photosensitive member 2 and the toner to be transferred second is set to be larger than that between the electrophotographic photosensitive member and the toners to be transferred first and third.

As shown in FIG. 5, the work of adhesion between the electrophotographic photosensitive member 2 and the toner to be transferred second is not less than 102.0% and not more than 132.7% of that between the electrophotographic photosensitive member and the toner to be transferred first, and is not less than 52.9 mN/m and not more than 64.5 mN/m, for example. Further, the work of adhesion between the electrophotographic photosensitive member and the toner transferred to be third is not less than 79.9% and not more than 120.5% of that between the electrophotographic photosensitive member and the toner to be transferred first, and is not less than 46.2 mN/m and not more than 61.7 mN/m, for example.

The work of adhesion between the electrophotographic photosensitive member 2 and the toner to be transferred first is not less than 42.4 mN/m and not more than 61.7 mN/m, for example, while the work of adhesion between the electrophotographic photosensitive member 2 and the black toner is not less than 37.7 mN/m and not more than 68.5 mN/m, for example.

Figure 3A:
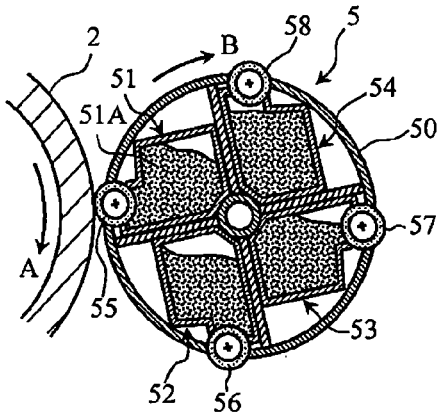
FIG. 3 is a sectional view illustrating the operation of a development mechanism used in the image forming apparatus of FIG. 1.
Figure 3B:
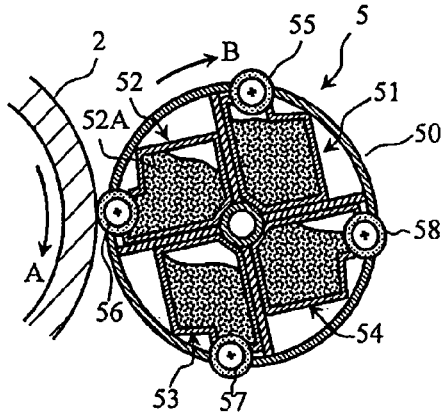
Figure 3C:
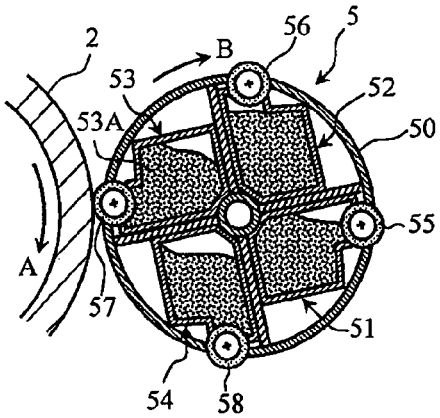
Figure 3D:
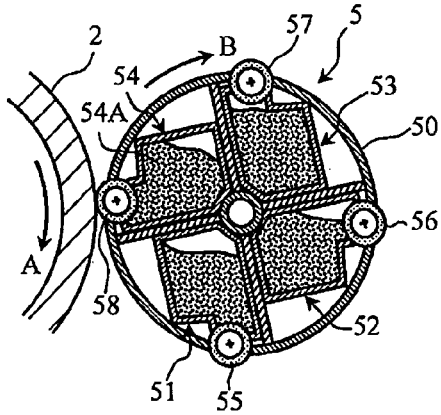

Next, the operation of the development mechanism 5 will be simply described, taking the case, when the image transfer to the intermediate transfer belt 60 is performed in the order of cyan, magenta, yellow and black (as described at the top of FIG. 4), as an example. In this case, in the development mechanism 5, the cyan toner 51A, the magenta toner 52A, the yellow toner 53A, and the black toner 54A are respectively accommodated in the developing units 51, 52, 53, and 54. First, as shown in FIG. 3A, the sleeve 55 of the developing unit 51 is brought into contact with the electrophotographic photosensitive member 2, and after electrification and exposure of the electrophotographic photosensitive member 2, development is performed by the cyan toner 51A whose toner image is transferred first to the intermediate transfer belt 60. Subsequently, for each of the magenta toner 52A, the yellow toner 53A, and the black toner 54A, in this order, the rotary holder is rotated by 90 degrees in the direction of the arrow B, and electrification, exposure, and development of the electrophotographic photosensitive member 2, as well as first image transfer to the intermediate transfer belt 60 are performed.

Finally, the toner images of cyan, magenta, yellow and black are superposed on the intermediate transfer belt 60, for forming a color toner image. Such color toner image is transferred to a recording paper P by applying transfer voltage to the second transfer roller 62, and then is fixed on the recording paper P by the fixing mechanism 7. In this way, a color image is formed on the recording paper P.

In the image forming apparatus 1, the work of adhesion of the toner to be transferred second is set to be larger than that of the toners to be transferred first and third. With such structure, undue adhesion or fusion of the toner at the electrophotographic photosensitive member 2 is prevented, and thus quality of the toner images transferred to the intermediate transfer belt 60 is enhanced. As a result, as will become apparent from the following embodiment, in the image forming apparatus 1, images of high quality without flaws of black spots or image deletion are obtained for a long period. The work of adhesion of the toners may be adjusted by changing the compositions of the toners.

Of course, the data shown in FIG. 5 (the amounts and relative values of the work of adhesion) is only an example. In the present image forming apparatus 1, it suffices if the work of adhesion of the toner to be transferred second is set to be larger than that of the toners to be transferred first and third.

Figure 6:
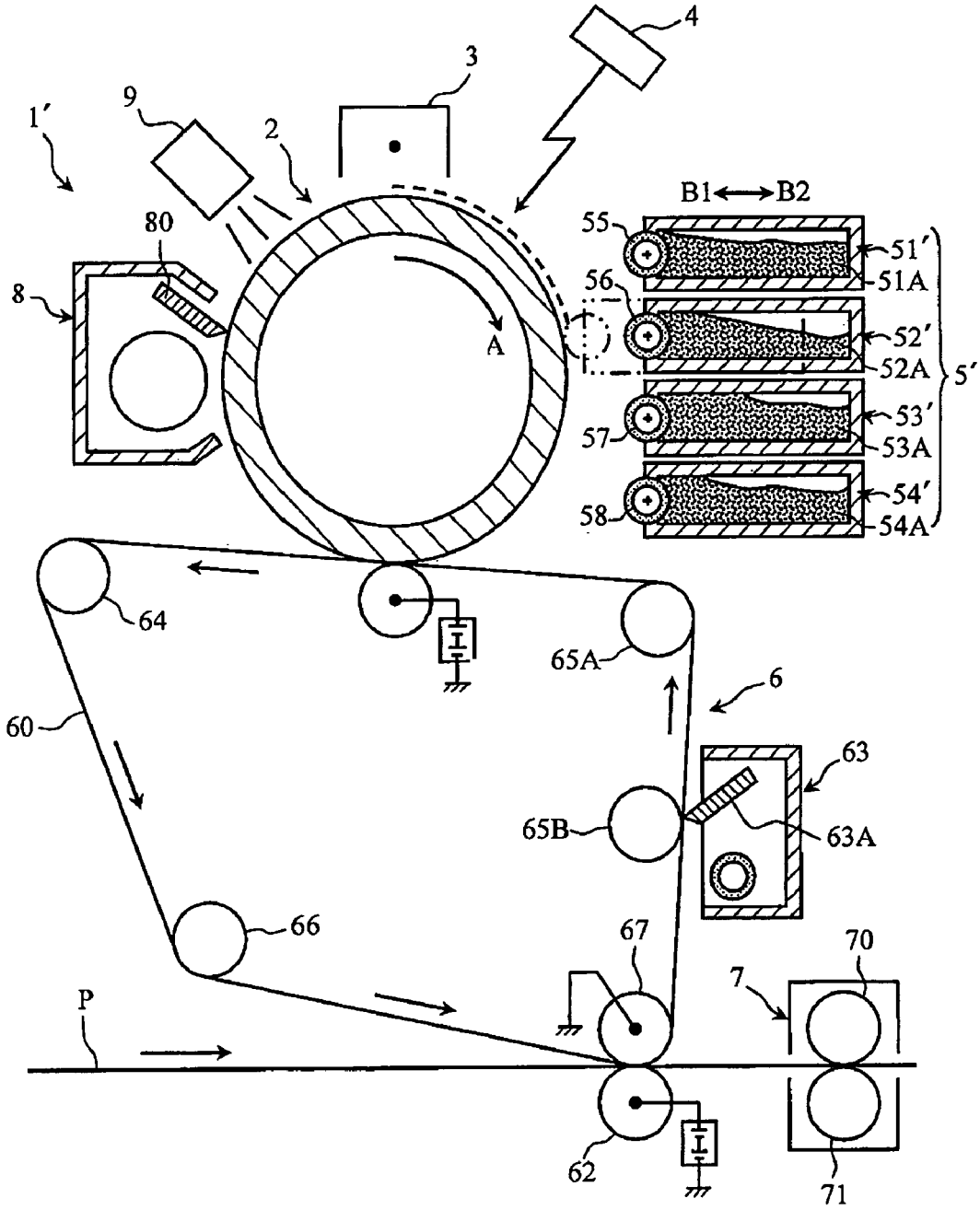
FIG. 6 is a sectional view schematically illustrating an image forming apparatus according to a second embodiment of the present invention.

Next, a second embodiment of the present invention will be described below with reference to FIG. 6. In FIG. 6, the elements similar to those of the image forming apparatus 1 (see FIG. 1) already described are given the same reference numbers and duplicated description will be omitted.

The image forming apparatus 1' illustrated in FIG. 6 utilizes a four-cycle system, though differs from the image forming apparatus 1 (see FIG. 1) already described in the structure of the development mechanism 5'. The development mechanism 5' utilizes a reverse system, and includes four developing units 51', 52', 53', 54'. The developing units 51'-54' are respectively provided with sleeves 55-58, and individually reciprocable in the direction of arrows B1, B2 in the figure.

In the image forming apparatus 1', similarly to the image forming apparatus 1 (see FIG. 1), the work of adhesion of the toner to be transferred second is set to be larger than that of the toners to be transferred first and third. For example, when forming toner images of the cyan, magenta, yellow and black in this order, the cyan toner 51A, the magenta toner 52A, the yellow toner 53A, and the black toner 54A are respectively accommodated in the developing units 51', 52', 53', and 54'. The developing unit 51' (cyan) is first brought into contact with the electrophotographic photosensitive member 2, while the other developing units 52'-54' are retracted, so that a toner image of the cyan toner 51A in the developing unit 51' is formed on the electrophotographic photosensitive member 2. Then, first image transfer of the toner image is performed to the intermediate transfer belt 60. Subsequently, the position of each the developing units 51'-54' is controlled and toner images of the developing units 52' (the magenta toner 52A), 53' (the yellow toner 53A), 54' (the black toner 54A) are formed on the electrophotographic photosensitive member 2, and the toner images are successively transferred to the intermediate transfer belt 60. In this way, each toner image of each color is superposed on the intermediate transfer belt 60 to form a color toner image. In second image transfer, this color toner image is transferred to the recording paper P, and then fixed thereon by the fixing mechanism 7.

Of course, the colors and compositions of the toners 51A-54A accommodated in the developing units 51'-54' may be changed variously, and the order of image transfer of the toners may be variously changed as shown in FIG. 4.

In such image forming apparatus 1' of a four-cycle system with the development mechanism 5 utilizing a reverse system, a color toner image is formed on the intermediate transfer belt 60 by one electrophotographic photosensitive member 2. By changing the compositions of the toners, the work of adhesion of the toner to be transferred second is set to be larger than that of the toners to be transferred first and third. With such structure, in the image forming apparatus 1', similarly to the image forming apparatus 1 (see FIG. 1), undue adhesion or fusion of the toner at the surface of the electrophotographic photosensitive member 2 is prevented, and thus quality of the toner images transferred to the intermediate transfer belt 60 is enhanced. As a result, images of high quality without flaws of black spots or image deletion are obtained for a long period.

Figure 7:
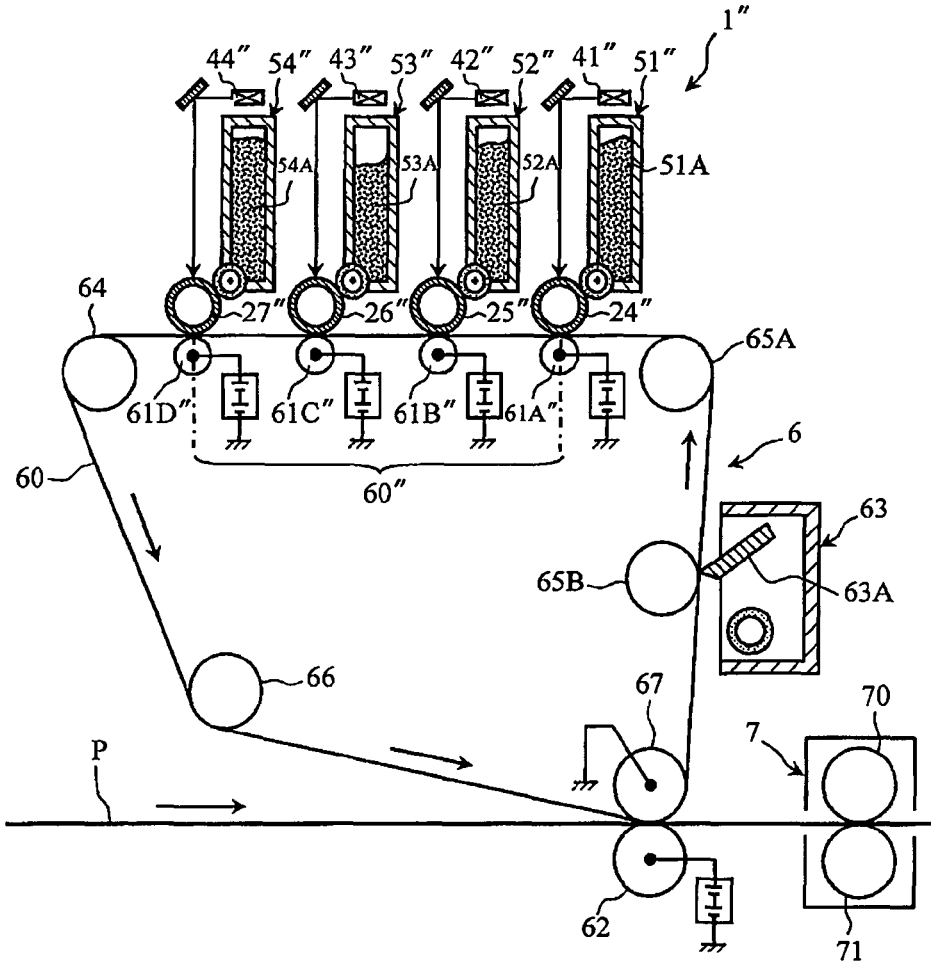
FIG. 7 is a sectional view schematically illustrating an image forming apparatus according to a third embodiment of the present invention.

Next, a third embodiment of the present invention will be described below with reference to FIG. 7. In FIG. 7, the elements similar to those of the image forming apparatus 1 (see FIG. 1) already described are given the same reference numbers and duplicated description will be omitted.

The image forming apparatus 1" utilizes a four-tandem system. The image forming apparatus 1" is provided with four electrophotographic photosensitive members 24", 25", 26", 27", and the electrophotographic photosensitive members 24"-27" are respectively provided with exposure mechanisms 41", 42", 43", 44", developing units 51"-54", and first transfer rollers 61A", 61B", 61C", 61D". Though omitted in the figure, each of the electrophotographic photosensitive members 24"-27" is also individually provided with an electrification mechanism, a discharge mechanism, and a cleaning mechanism.

In the image forming apparatus 1", each of the developing units 51"-54" accommodates a toner of desired color and composition. The developing units 51"-54" respectively form toner images on the electrophotographic photosensitive members 24", 25", 26", 27", and the toner images are transferred to the intermediate transfer belt 60. For example, in the image forming apparatus 1", when toner images are transferred to the intermediate transfer belt 60 in the order of cyan, magenta, yellow, and black, the cyan toner 51A, the magenta toner 52A, the yellow toner 53A, the black toner 54A are respectively accommodated in the developing units 51", 52", 53", and 54". In this case, a cyan toner image, a magenta toner image, a yellow toner image, and a black toner image are respectively formed on the electrophotographic photosensitive member 24", 25", 26", and 27".

Meanwhile, in a first transfer area 60" of the intermediate transfer belt 60, the developing unit 51" (the cyan toner 51A), the developing unit 52" (the magenta toner 52A), the developing unit 53" (the yellow toner 53A), and the developing unit 54" (the black toner 54A) are arranged in this order from the upper stream side of the moving direction of the intermediate transfer belt 60. Thus, in the first transfer area 60", toner images of cyan, magenta, yellow, and black are respectively formed on the electrophotographic photosensitive member 24", 25", 26", and 27" in the mentioned order.

Also in such image forming apparatus 1", when transferring images of the electrophotographic photosensitive members 24"-27" to the intermediate transfer belt 60, the work of adhesion of the toner to be transferred second is set to be larger than that of the toners to be transferred first and third. Further, in the image forming apparatus 1", since the developing units 51"-54" respectively correspond to the electrophotographic photosensitive members 24"-27", in addition to compositions of toners, the surface free energy of the electrophotographic photosensitive members 24"-27" may be controlled, so that the work of adhesion of the toner to be transferred second is set to be larger than that of the toners to be transferred first and third. The surface free energy of the electrophotographic photosensitive members 24"-27" is controlled by changing the states of irregularities on the surfaces (surface roughness) or the surface compositions of the electrophotographic photosensitive members 24"-27".

Of course, the colors and compositions of the toners 51A-54A accommodated in the developing units 51"-54" may be changed variously, and the order of image transfer of the toners may be variously changed as shown in FIG. 4.

With such image forming apparatus 1" utilizing a four-tandem system, similarly to the image forming apparatus 1 (see FIG. 1), undue adhesion or fusion of the toner at the surface of the electrophotographic photosensitive members 24"-27" is prevented, and thus quality of the toner image transferred to the intermediate transfer belt 60 is enhanced. As a result, images of high quality without flaws of black spots or image deletion are obtained for a long period.

In the above-described first to third embodiments, the toner images of the electrophotographic photosensitive members 2, 24"-27" of the image forming apparatuses 1, 1', 1" are transferred to the intermediate transfer belt. However, the present invention may also be applied to an image forming apparatus in which the toner images of the electrophotographic photosensitive members 2, 24"-27" are directly transferred to the recording paper P.

EXAMPLE 1

In the present example, it was studied how the composition (work of adhesion) of toners and the order of image transfer to an intermediate transfer body affect the image property of images printed by the image forming apparatus 1 shown in FIG. 1.

(Manufacture of Photosensitive Member)

As the photosensitive member 2, an a-Si photosensitive member was used. The photosensitive member 2 included a cylindrical body 20 prepared by making a drawn tube of aluminum alloy with outer diameter of 30 mm, length of 340 mm and thickness of 1.5 mm, and then performing mirror finishing on the circumferential outer surface of the drawn tube before cleaning. The cylindrical body was incorporated in a glow discharge decomposition device, and the anti-charge injection layer 21, the photoconductive layer 22, and the surface layer 23 were formed under the film forming conditions shown in the following Table 1.

TABLE 1

| Layer | Gas Flow Amount $SiH_4$ | NO | $B_2H_6$ | $H_2$ | $CH_4$ | RF Electric Power (W) | Board Temperature (° C.) | Gas Pressure (Pa) | Film Thickness (μm) |
|---|---|---|---|---|---|---|---|---|---|
| Surface Layer | 83 | — | — | 3000 | 3000 | 3500 | 280 | 45 | 1 |
| Photoconductive Layer | 2500 | — | 0.4 ppm* | 1800 | — | 2800 | 270 | 45 | 15 |
| Anti-charge Injectio Layer | 1500 | 10% | 0.16%* | 2000 | — | 1500 | 250 | 45 | 5 |

*ratio to $SiH_4$ (Toners)

The following Table 2 indicates toners used in the example. The work of adhesion was measured by a contact angle meter CX-ROLL and a surface free energy analysis software EG-11 manufactured by Kyowa Interface Science Co., Ltd. Specifically, using the contact angle meter CX-ROLL manufactured by Kyowa Interface Science Co., Ltd., a liquid (containing dispersion force component, dipole component, and hydrogen bond component, each with known surface free energy value; such as water, ethylene glycol, and methylene iodide), was dropped, and its contact angle at a toner pellet was measured utilizing drop method, in a room under a controlled temperature of 20-24° C., thereby analyzing the surface free energy of the toner. The toner pellet was formed into a cylinder with a diameter of 5 mm and a height of 10 mm. Subsequently, using the data of the surface free energy of the toner, the work of adhesion was calculated based on extended Fowkes theory.

TABLE 2

| Toner | Work of Adhesion | Product Name (Manufacturer) |
|---|---|---|
| Yellow-1 | 61.7 mN/m | TK-816Y (Kyocera Mita Corporation) |
| Yellow-2 | 46.2 mN/m | TK-827Y (Kyocera Mita Corporation) |
| Yellow-3 | 52.9 mN/m | NPG-24 Toner Y (Canon Inc.) |
| Magenta-1 | 61.3 mN/m | TK-816M (Kyocera Mita Corporation) |

TABLE 2-continued

| Toner | Work of Adhesion | Product Name (Manufacturer) |
|---|---|---|
| Magenta-2 | 57.8 mN/m | TK-827M (Kyocera Mita Corporation) |
| Magenta-3 | 42.7 mN/m | NPG-24 Toner M (Canon Inc.) |
| Cyan-1 | 64.5 mN/m | TK-816C (Kyocera Mita Corporation) |
| Cyan-2 | 62.5 mN/m | TK-827C (Kyocera Mita Corporation) |
| Cyan-3 | 51.1 mN/m | NPG-24 Toner C (Canon Inc.) |
| Black-1 | 68.5 mN/m | TK-816K (Kyocera Mita Corporation) |
| Black-2 | 55.6 mN/m | TK-827K (Kyocera Mita Corporation) |
| Black-3 | 37.7 mN/m | NPG-24 Toner BK (Canon Inc.) |

(Evaluation of Image Property)

In evaluation of image property, the image forming apparatus 1 performed printing of 10 thousand copies, and then performed white solid image printing and solid image printing using yellow, magenta, cyan and black toners. The evaluation results are shown in the following Table 3. In Table 3, the evaluation results were respectively indicated as "○" when good solid image of white or other colors was obtained, as "Δ" when a slight flaw of dots or streaks which may not cause any practical problem was found, and as "x" when a significant flaw of dots or streaks was found.

TABLE 3

| No. | | First Cycle | Second Cycle | Third Cycle | Fourth Cycle | Evaluation |
|---|---|---|---|---|---|---|
| 1 | Toner (Color) | Magenta-1 | Cyan-1 | Yellow-1 | Black-1 | ◎ |
| | Work of Adhesion | 61.3 mN/m | 64.5 mN/m | 61.7 mN/m | 68.5 mN/m | |
| | (Relative Value) | (100%) | (105.2%) | (100.7%) | (111.7%) | |
| 2 | Toner (Color) | Magenta-1 | Yellow-1 | Cyan-1 | Black-1 | X |
| | Work of Adhesion | 61.3 mN/m | 61.7 mN/m | 64.5 mN/m | 68.5 mN/m | |
| | (Relative Value) | (100%) | (100.7%) | (105.2%) | (111.7%) | |
| 3 | Toner (Color) | Cyan-1 | Magenta-1 | Yellow-1 | Black-1 | X |
| | Work of Adhesion | 64.5 mN/m | 61.3 mN/m | 61.7 mN/m | 68.5 mN/m | |
| | (Relative Value) | (100%) | (95.0%) | (95.7%) | (116.2%) | |
| 4 | Toner (Color) | Yellow-1 | Cyan-1 | Magenta-1 | Black-1 | ◎ |
| | Work of Adhesion | 61.7 mN/m | 64.5 mN/m | 61.3 mN/m | 68.5 mN/m | |
| | (Relative Value) | (100%) | (104.5%) | (100.7%) | (110.0%) | |
| 5 | Toner (Color) | Magenta-2 | Cyan-2 | Yellow-2 | Black-2 | ◎ |
| | Work of Adhesion | 57.8 mN/m | 62.5 mN/m | 46.2 mN/m | 55.6 mN/m | |
| | (Relative Value) | (100%) | (108.1%) | (79.9%) | (97.2%) | |
| 6 | Toner (Color) | Magenta-2 | Yellow-2 | Cyan-2 | Black-2 | X |
| | Work of Adhesion | 57.8 mN/m | 46.2 mN/m | 62.5 mN/m | 55.6 mN/m | |
| | (Relative Value) | (100%) | (79.9%) | (108.1%) | (97.2%) | |

TABLE 3-continued

| No. | | First Cycle | Second Cycle | Third Cycle | Fourth Cycle | Evaluation |
|---|---|---|---|---|---|---|
| 7 | Toner (Color) | Magenta-3 | Yellow-3 | Cyan-3 | Black-3 | ◎ |
| | Work of Adhesion | 42.4 mN/m | 52.9 mN/m | 51.1 mN/m | 37.7 mN/m | |
| | (Relative Value) | (100%) | (124.8%) | (120.5%) | (88.9%) | |
| 8 | Toner (Color) | Cyan-3 | Magenta-3 | Yellow-3 | Black-3 | X |
| | Work of Adhesion | 51.1 mN/m | 42.4 mN/m | 52.9 mN/m | 37.7 mN/m | |
| | (Relative Value) | (100%) | (83.0%) | (103.5%) | (73.8%) | |
| 9 | Toner (Color) | Magenta-2 | Cyan-1 | Yellow-2 | Black-1 | ◎ |
| | Work of Adhesion | 57.8 mN/m | 64.5 mN/m | 46.2 mN/m | 68.5 mN/m | |
| | (Relative Value) | (100%) | (111.6%) | (79.9%) | (118.5%) | |
| 10 | Toner (Color) | Magenta-1 | Cyan-2 | Yellow-1 | Black-1 | ◎ |
| | Work of Adhesion | 61.3 mN/m | 62.5 mN/m | 61.7 mN/m | 68.5 mN/m | |
| | (Relative Value) | (100%) | (102.0%) | (100.7%) | (111.7%) | |
| 11 | Toner (Color) | Yellow-3 | Magenta-3 | Cyan-3 | Black-3 | X |
| | Work of Adhesion | 52.9 mN/m | 42.4 mN/m | 51.1 mN/m | 37.7 mN/m | |
| | (Relative Value) | (100%) | (80.2%) | (96.6%) | (71.3%) | |
| 12 | Toner (Color) | Yellow-3 | Magenta-1 | Cyan-3 | Black-3 | ○ |
| | Work of Adhesion | 46.2 mN/m | 61.3 mN/m | 51.1 mN/m | 37.7 mN/m | |
| | (Relative Value) | (100%) | (132.7%) | (96.6%) | (81.6%) | |
| 13 | Toner (Color) | Cyan-3 | Yellow-1 | Magenta-1 | Black-3 | ◎ |
| | Work of Adhesion | 51.1 mN/m | 61.7 mN/m | 61.3 mN/m | 37.7 mN/m | |
| | (Relative Value) | (100%) | (120.7%) | (120.0%) | (73.8%) | |

As can be seen from the results shown in Table 3, among the toners transferred first to third, when the work of adhesion of the toner to be transferred second was the largest, good images without flaws were obtained. Here, the work of adhesion of the toner to be transferred second was not less than 102.0% and not more than 132.7% of that of the toner to be transferred first. The work of adhesion of the toner to be transferred third was not less than 79.9% and not more than 120.5% of that of the toner to be transferred first.

Meanwhile, when good images were obtained, the works of adhesions of the toners transferred first to third were not less than 42.4 mN/m and not more than 61.7 mN/m, not less than 52.9 mN/m and not more than 64.5 mN/m, and not less than 46.2 mN/m and not more than 61.7 mN/m, respectively.

The invention claimed is:

1. An image forming apparatus comprising:

one or a plurality of photosensitive members on which an electrostatic latent image is formed according to an image signal;

a development mechanism for forming a toner image by developing the electrostatic latent images: and a transfer body to which the toner image is transferred, wherein the development mechanism includes a plurality of developing units holding toners comprising a first toner, a second toner to be transferred to the transfer body after the first toner, and a third toner to be transferred to the transfer body after the first and the second toners, wherein a second work of adhesion between the photosensitive member and the second toner is larger than a first work of adhesion between the photosensitive member and the first toner and a third work of adhesion between the photosensitive member and the third toner, wherein the second work of adhesion is not less than 102.0% and not more than 132.7% of the first work of adhesion.

2. The image forming apparatus according to claim 1, wherein the third work of adhesion is not less than 79.9% and not more than 120.5% of the first work of adhesion.

3. The image forming apparatus according to claim 1, wherein the first work of adhesion is not less than 42.4 mN/m and not more than 61.7 mN/m, the second work of adhesion is not less than 52.9 mN/m and not more than 64.5 mN/m, and the third work of adhesion is not less than 46.2 mN/m and not more than 61.7 mN/m.

4. An image forming method comprising:

forming an electrostatic latent image on one or a plurality of photosensitive members according to an image signal;

forming a toner image by developing the electrostatic latent image using toners comprising a first toner, a second toner to be transferred to the transfer body after the first toner, and a third toner to be transferred to the transfer body after the first and the second toners:

and transferring the toner image to a transfer body, wherein the toners are selected so that a second work of adhesion between the photosensitive member and the second toner is larger than a first work of adhesion between the photosensitive member and the first toner and a third work of adhesion between the photosensitive member and the third toner, wherein the second work of adhesion is not less than 102.0% and not more than 132.7% of the first work of adhesion.

5. The image forming method, according to claim 4, wherein the third work of adhesion is not less than 79.9% and not more than 120.5% of the first work of adhesion.

6. The image forming method according to claim 4, wherein the first work of adhesion is not less than 42.4 mN/m and not more than 61.7 mN/m, the second work of adhesion is not less than 52.9 mN/m and not more than 64.5 mN/m, and the third work of adhesion is not less than 46.2 mN/m and not more than 61.7 mN/m.

* * * * *